US009415405B2

(12) United States Patent
Shelman

(10) Patent No.: US 9,415,405 B2
(45) Date of Patent: Aug. 16, 2016

(54) DEFLECTOR CAP FOR PREVENTING A SPRINKLER FROM SPRAYING WATER IN A GIVEN DIRECTION

(71) Applicant: Tony Albert Shelman, Houston, TX (US)

(72) Inventor: Tony Albert Shelman, Houston, TX (US)

( * ) Notice: Subject to any disclaimer, the term of this patent is extended or adjusted under 35 U.S.C. 154(b) by 26 days.

(21) Appl. No.: 14/218,291

(22) Filed: Mar. 18, 2014

(65) Prior Publication Data

US 2015/0266038 A1 Sep. 24, 2015

(51) Int. Cl.

| | |
|---|---|
| ***B05B 1/00*** | (2006.01) |
| ***B05B 1/28*** | (2006.01) |
| ***B05B 15/10*** | (2006.01) |

(52) U.S. Cl.

CPC .. *B05B 1/28* (2013.01); *B05B 15/10* (2013.01)

(58) Field of Classification Search

CPC B05B 15/04; B05B 15/0437; B05B 15/0443; B05B 15/0493; B05B 15/001

USPC ..... 239/288, 288.3, 288.5, 231, 222.13, 239/666, 504, 505

See application file for complete search history.

(56) References Cited

U.S. PATENT DOCUMENTS

| | | | | |
|---|---|---|---|---|
| 4,461,423 | A * | 7/1984 | Davis | 239/231 |
| 5,806,416 | A * | 9/1998 | Cerniglia et al. | 100/90 |
| 7,066,404 | B1 * | 6/2006 | Kollar | 239/288 |
| 2005/0023378 | A1 * | 2/2005 | Gregory | B05B 1/02 239/522 |

FOREIGN PATENT DOCUMENTS

| | | | | |
|---|---|---|---|---|
| AU | WO 8303064 | A1 * | 9/1983 | A62C 37/09 |
| FR | 2708830 | A1 * | 2/1995 | |

* cited by examiner

*Primary Examiner* — Arthur O Hall
*Assistant Examiner* — Viet Le
(74) *Attorney, Agent, or Firm* — Polsinelli PC; Adam C. Rehm; Michael D. Pegues

(57) ABSTRACT

A system for preventing a sprinkler from spraying water in a given direction may include a deflector cap having a top surface, and a skirt extending from the top surface, the skirt having a cap opening configured to align with a nozzle orifice in a sprinkler nozzle, and a fastener configured to attach the deflector cap to the sprinkler nozzle. The skirt may be configured to prevent water from spraying from the nozzle in a given direction. In embodiments, the fastener may be a snap on ring positioned on an inner surface of the top surface of the deflector cap, a hook system, and/or an adhesive. The sprinkler may be a pop up sprinkler that is configured to retract into a ground when not in use, the pop up sprinkler comprising a sprinkler cap, and the deflector cap may be configured to retract into the ground, covering the sprinkler cap.

19 Claims, 4 Drawing Sheets

DEFLECTOR CAP FOR PREVENTING A SPRINKLER FROM SPRAYING WATER IN A GIVEN DIRECTION

BACKGROUND

The embodiments herein relate generally to landscaping equipment and, more particularly, to a sprinkler cap that prevents the sprinkler from spraying water in a given direction.

Pop up sprinklers are often times used to water a grass area, such as a homeowner's back yard. However, when pop up sprinklers are positioned too closely to fences or other structures, such as houses or sheds, water is sprayed from the sprinkler head onto the fence or other structure, leaving an unattractive water stain and, potentially, damaging the fence or structure. Existing systems for preventing water from spraying on structures only work with stationary and above ground sprinklers and not with pop up sprinklers that retract into the ground when not in use.

Therefore, what is needed is a deflector cap configured to attach to a pop up sprinkler, the deflector cap being capable of preventing water from spraying from the sprinkler in a given direction.

SUMMARY

Some embodiments of the present invention include a system for preventing a sprinkler from spraying water in a given direction, the system comprising a deflector cap having a top surface, and a skirt extending from the top surface, the skirt having a cap opening configured to align with a nozzle orifice in a sprinkler nozzle, and a fastener configured to attach the deflector cap to the sprinkler nozzle. The skirt may be configured to prevent water from spraying from the nozzle in a given direction. In embodiments, the fastener may be a snap on ring positioned on an inner surface of the top surface of the deflector cap, a hook system, and/or an adhesive. The sprinkler may be a pop up sprinkler that is configured to retract into a ground when not in use, the pop up sprinkler comprising a sprinkler cap, and the deflector cap may be configured to retract into the ground, covering the sprinkler cap.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The system of the present disclosure may be used to prevent a sprinkler from spraying water in a given direction and may comprise the following elements. This list of possible constituent elements is intended to be exemplary only, and it is not intended that this list be used to limit the system of the present application to just these elements. Persons having ordinary skill in the art relevant to the present disclosure may understand there to be equivalent elements that may be substituted within the present disclosure without changing the essential function or operation of the system.

1. Deflector Cap
2. Fastener

The various elements of the system for preventing a sprinkler from spraying water in a given direction of the present disclosure may be related in the following exemplary fashion. It is not intended to limit the scope or nature of the relationships between the various elements and the following examples are presented as illustrative examples only.

Figure 6:
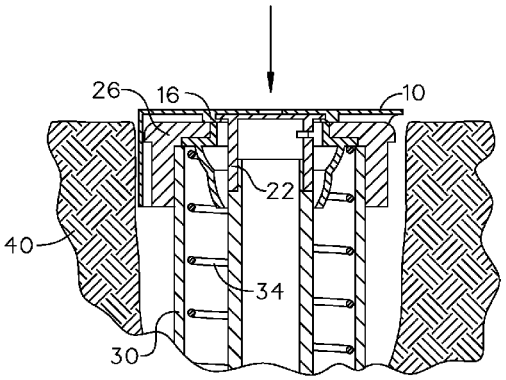
FIG. 6 is a section view of one embodiment of the present invention, illustrating the movement of the deflector cap when the sprinkler retracts.
Figure 7:
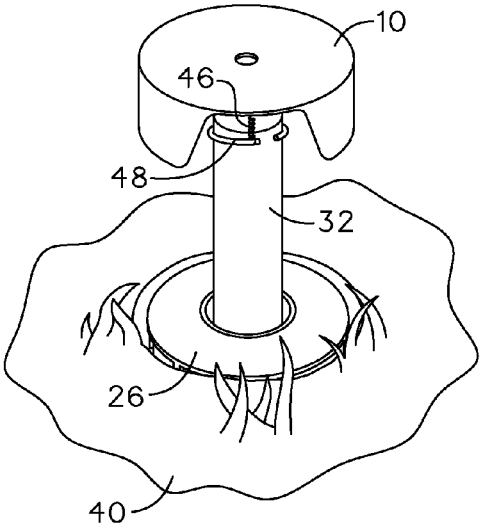
FIG. 7 is a perspective view of one embodiment of the present invention, shown in use.
Figure 8:
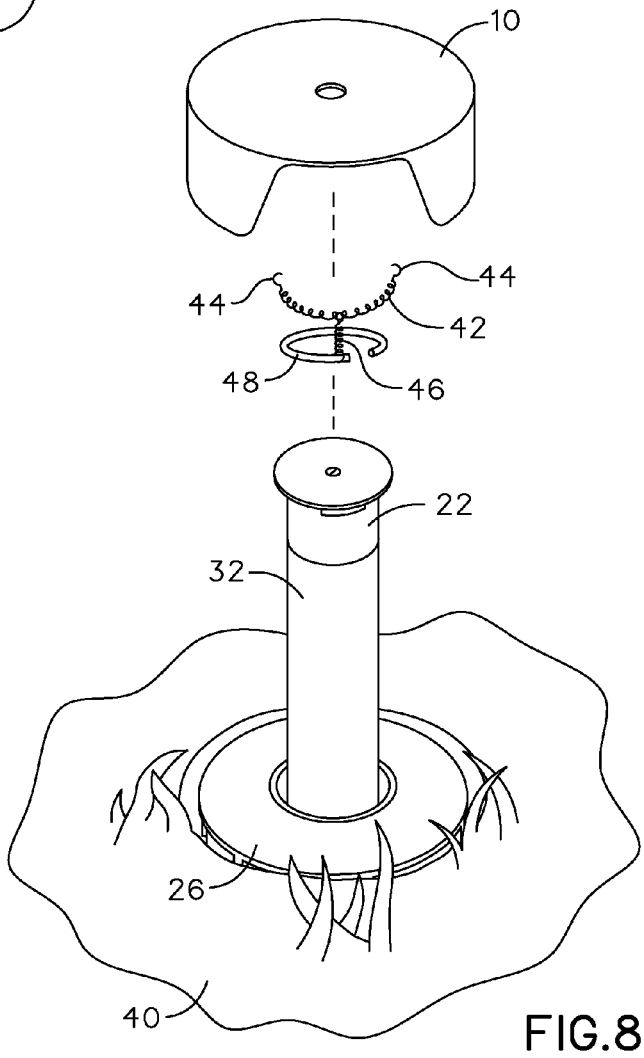
FIG. 8 is an exploded view of one embodiment of the present invention.

By way of example, and referring to FIGS. 1-8, embodiments of the present invention comprises a deflector cap 10 having a cap opening 12, wherein the deflector cap 10 is configured to attach to a pop up sprinkler using a fastener. For example, as shown in FIGS. 2-6, the deflector cap 10 may have a snap on ring 16 located on an inner surface of a top surface thereof, wherein the ring 16 is concentric with the deflector cap 10 and is configured to engage with the nozzle lip 20 of a pop up sprinkler The nozzle lip 20 may snap into the ring notch 18 such that the deflector cap 10 will not fall off of the sprinkler during operation of the sprinkler. Alternatively, as shown in FIGS. 7 and 8 the deflector cap 10 may further comprise a cap spring 42 having a first end and a second end, each of the ends comprising a cap spring hook 14. The cap spring hooks 14 may be configured to engage with, or hook onto, the deflector cap 10. Extending from a central portion of the cap spring 42 may be a hook spring connector 46. The hook spring connector 46 may be configured to attach to a hook 48, which in turn attaches to the sprinkler by wrapping around the sprinkler riser 32. The hook 48 may wrap around the sprinkler riser 32 in such a manner that the deflector cap 10 will not fall off of the sprinkler during operation thereof. In embodiments, an adhesive, such as water resistant glue, may also be used to attach the deflector cap 10 to the sprinkler.

Figure 1:
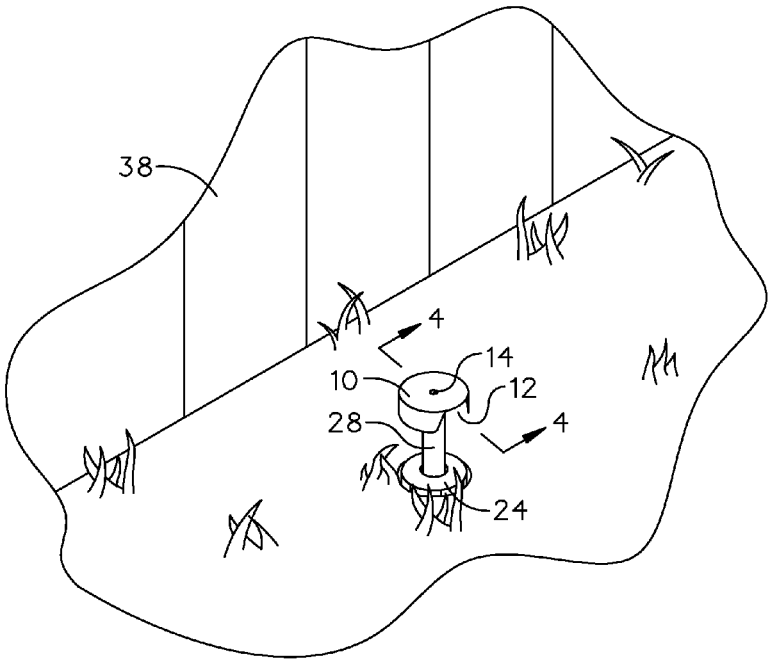
FIG. 1 is a perspective view of one embodiment of the present invention, shown in use.
Figure 2:
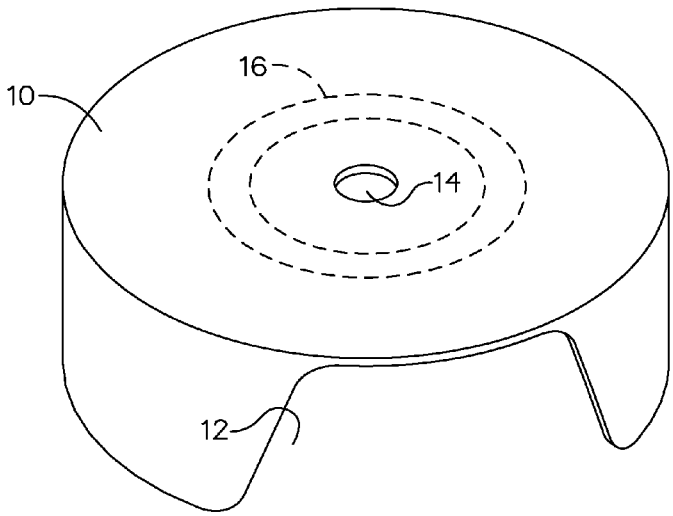
FIG. 2 is a perspective view of one embodiment of the present invention.
Figure 3:
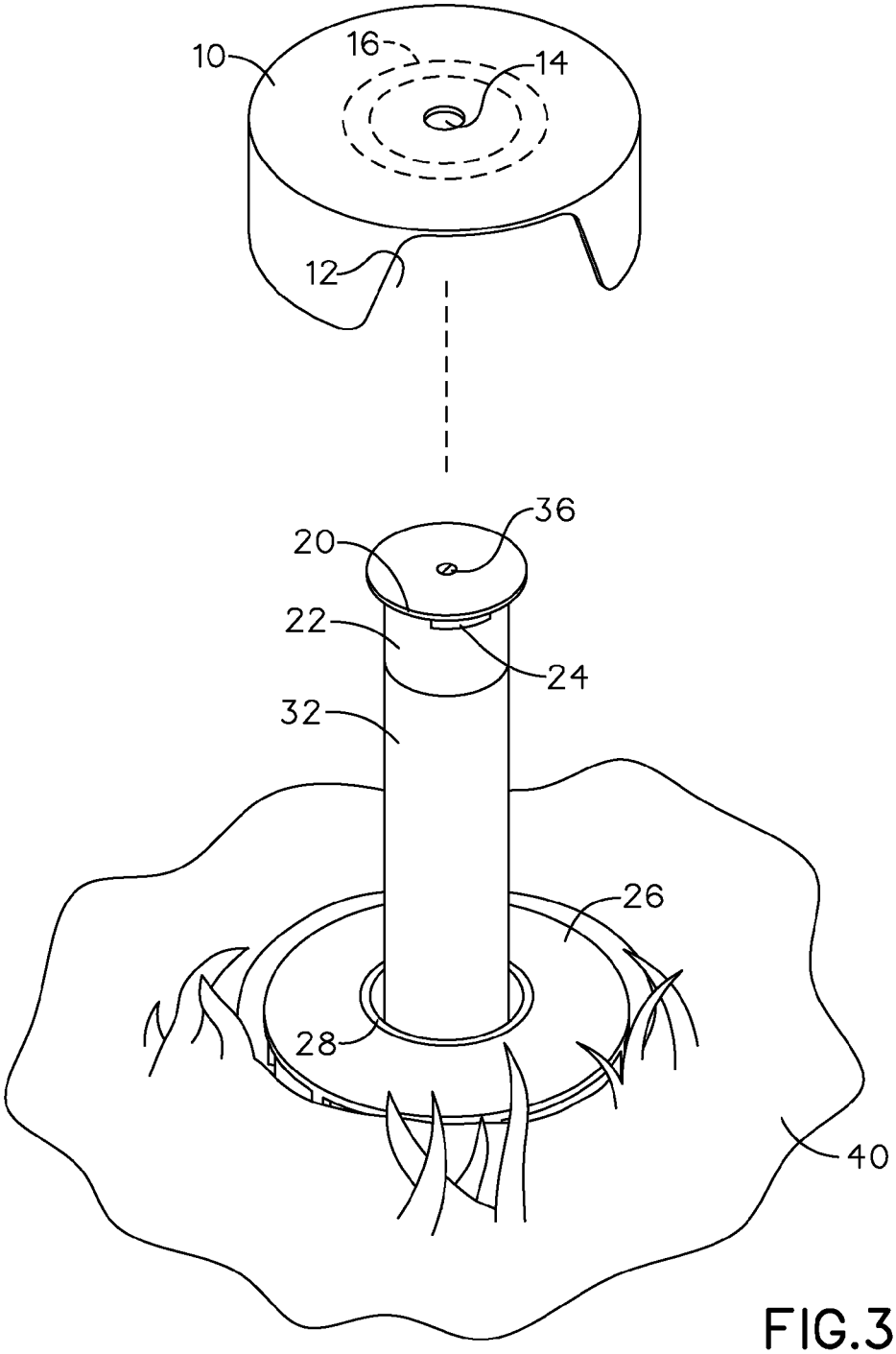
FIG. 3 is an exploded view of one embodiment of the present invention.
Figure 4:
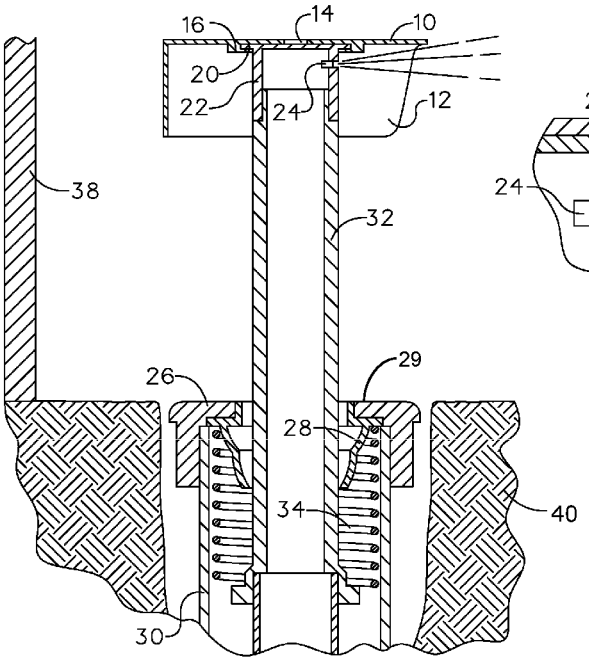
FIG. 4 is a section view of one embodiment of the present invention, taken along line 4-4 in FIG. 1, with the nozzle simplified for clarity.
Figure 5:
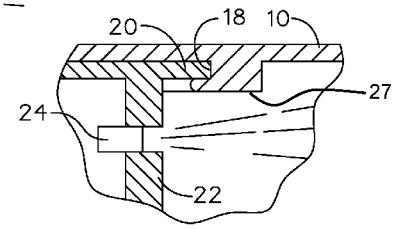
FIG. 5 is a detailed section view of one embodiment of the present invention.

In embodiments, the deflector cap 10 comprises a top surface and a lip or skirt extending therefrom. The lip or skirt may have a cap opening 12 therein. The lip or skirt may prevent or block water from spraying in a given direction, while the cap opening 12 allows water to be sprayed in the desired direction. Thus, when attaching the deflector cap 10 to a pop up sprinkler, a user will want to position the cap opening 12 to face the direction that water is desired to be sprayed, while facing the lip in the direction that water is not to be sprayed, as shown in FIGS. 1 and 4.

Embodiments of the deflector cap 10 may include a radius screw access orifice 14 in a top surface thereof, such that a user may be able to access the adjustment screw 36 on the nozzle 22 of a pop up sprinkler. The radius screw access orifice 14 may be substantially circular in shape and may have a diameter of about 13/16 inches.

Embodiments of the deflector cap 10 may have a diameter just larger than a diameter of the sprinkler cap 26 positioned within the ground 40 such that, when the pop up sprinkler retracts into the ground 40, the deflector cap 40 fits over the sprinkler cap 26 with an abutment surface 27 on a lowermost portion of the ring 16 abutting an uppermost surface 29 of the sprinkler cap 26, as shown in FIG. 6. Thus, when the sprinkler is not in use and is refracted into the ground 40, the deflector cap 10 may be substantially level with the ground 40. For example, the deflector cap 10 may be substantially circular and may have a diameter of about 50 mm to about 65 mm, such as about 61 mm. When included, the snap on ring 16 may have a diameter of about 22 mm. The skirt or lip of the deflector cap 10 may be long enough to cover the entire sprinkler cap, as shown in FIG. 6. For example, the skirt or lip of the deflector cap 10 may have a length of from about 2 mm to about 4 mm, such as about 2.2 mm. The deflector cap 10 may be made of any suitable material that is durable and not damaged by water, such as plastic or any other conventional sprinkler system material.

Embodiments of the deflector cap 10 may be configured not to interfere with the area of the nozzle 22 directly above the nozzle orifice 24 or, in other words, the area between the nozzle orifice 24 and the nozzle lip 20.

Embodiments of a pop up sprinkler system having the deflector cap 10 installed therein may comprise a pop up sprinkler comprising a sprinkler body 30 positioned in the ground 40, the sprinkler body 30 housing a sprinkler screw 34 configured to rise a sprinkler riser 32 out of the ground through a nozzle orifice 22 in a sprinkler cap 26, wherein the sprinkler cap 26 is configured to cover the sprinkler body 30 and has a wiper seal 28, the sprinkler riser 32 having a nozzle 22 attached at a distal end thereof, the nozzle 22 having a nozzle lip 20 and a nozzle orifice 24, and a deflector cap 10 attached to the nozzle 22 using a snap on ring 16 configured to engage with the nozzle lip 20, a hook 48 configured to engage with the deflector cap 10 and the sprinkler riser 32, and/or an adhesive. The pop up sprinkler system having the deflector cap installed therein may prevent the sprinkler from spraying water in an undesired direction, such as towards a fence or other structure. As a result, the deflector cap may prevent damage to structures or areas surrounding the pop up sprinkler system. Additionally, because the entire system, including the deflector cap, the deflector cap may not interfere with landscape machinery, such as lawn mowers.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A system for preventing a sprinkler from spraying water in a given direction, the system comprising:

a deflector cap comprising:

a top surface; and an exterior skirt (i) extending from the top surface, and (ii) having an exterior skirt cap opening configured to align with a nozzle orifice in a sprinkler nozzle; and a fastener configured to attach the deflector cap to the sprinkler nozzle, the fastener comprising:

an interior skirt (i) extending from the top surface, and (ii) having an abutment surface configured to space a portion of the sprinkler nozzle from another portion of the sprinkler nozzle when (a) the sprinkler nozzle is partially retracted into the another portion and not in use, and (b) the abutment surface abuts the another portion of the sprinkler nozzle, the abutment surface spaced from the another portion of the sprinkler nozzle when the sprinkler nozzle is in use, wherein, the exterior skirt is configured to prevent water from spraying from the nozzle orifice in the sprinkle nozzle in a given direction, the interior skirt is configured to receive the portion of the sprinkler nozzle.

2. The system of claim 1, wherein the fastener is at least one member selected from the group consisting of a snap on ring positioned on an inner surface of the top surface of the deflector cap, a hook system, an adhesive, and a mixture thereof.

3. The system of claim 2, wherein:

the fastener with the interior skirt is a snap on ring; and the snap on ring protrudes from the inner surface of the top surface of the deflector cap and comprises a ring notch configured to engage with a nozzle lip of the sprinkler nozzle.

4. The system of claim 2, wherein:

the fastener is a hook system; and the hook system comprises:

a cap spring having a central portion, a first end, and a second end, each of the ends comprising a cap spring hook, the cap spring hooks being configured to engage with the deflector cap;

a hook spring connector extending from the central portion of the cap spring, the hook spring connector being configured to attach to a hook, the hook being configured to wrap around a sprinkler riser of the sprinkler system.

5. The system of claim 1, wherein the top surface of the deflector cap comprises an access orifice, which is configured to grant a user access to an adjustment screw positioned on the sprinkler nozzle.

6. The system of claim 1, wherein:

the sprinkler is a pop up sprinkler that is configured to retract into a ground when not in use, the pop up sprinkler comprising a sprinkler cap; and the deflector cap is configured to retract into the ground, covering the sprinkler cap.

7. The system of claim 1, wherein the deflector cap is substantially circular and has a diameter of about 50 mm to about 65 mm.

8. A system for preventing a sprinkler from spraying water in a given direction, the system comprising:

a pop up sprinkler system comprising:

a sprinkler body positioned in a ground, the sprinkler body (i) housing a component configured to allow a sprinkler riser to rise out of the ground, and having a nozzle orifice in a sprinkler cap, wherein the sprinkler cap is configured to cover the sprinkler body and has a wiper seal; and a nozzle attached at a distal end of the sprinkler riser, the nozzle having a nozzle lip and a nozzle orifice; and a deflector cap attached to the nozzle of the pop up sprinkler system, wherein the deflector cap includes an exterior skirt with a cap opening and an interior skirt with an abutment surface, the exterior skirt configured to block water from spraying from the nozzle orifice in a given direction, the cap opening aligned with the nozzle orifice, the abutment surface configured to space the nozzle lip of the sprinkler nozzle from a portion of the sprinkler nozzle when (i) the sprinkler nozzle is partially retracted into the portion of the sprinkler nozzle, and (ii) the abutment surface abuts the portion of the sprinkler nozzle, the abutment surface spaced from the portion of the sprinkler nozzle when the sprinkler nozzle is in use.

9. The system of claim 8, wherein the interior skirt is part of a fastener configured to attach the deflector cap to the nozzle.

10. The system of claim 8, wherein the deflector cap is configured to retract into the ground, covering the sprinkler cap.

11. The system of claim 1,
wherein,
the interior skirt is configured to be slidably received by the portion of the sprinkler.

12. The system of claim 1,
wherein,
when the interior skirt is received by the portion of the sprinkler top surface, (ii) the deflector cap extends horizontally beyond the nozzle orifice, and (ii) the exterior skirt partially surrounds the nozzle orifice.

13. The system of claim 8,
wherein,
the interior skirt is configured to be slidably received by the portion of the sprinkler.

14. The system of claim 8,
wherein,
when the interior skirt is received by the portion of the sprinkler top surface, (ii) the deflector cap extends horizontally beyond the nozzle orifice, and (ii) the exterior skirt partially surrounds the nozzle orifice.

15. The system of claim 1,
wherein,
the abutment surface of the interior skirt is a lowermost surface of the interior skirt.

16. The system of claim 15,
wherein,
the portion of the sprinkler nozzle is a nozzle lip of the sprinkler nozzle.

17. The system of claim 16,
wherein,
the another portion of the sprinkler nozzle is an uppermost surface of a sprinkler cap.

18. The system of claim 8,
wherein,
the abutment surface of the interior skirt is a lowermost surface of the interior skirt.

19. The system of claim 18,
wherein,
the portion of the sprinkler nozzle is an uppermost surface of a sprinkler cap.

* * * * *